United States Patent [19]

Kimbrough

[11] Patent Number: 4,805,270

[45] Date of Patent: Feb. 21, 1989

[54] APPARATUS FOR SECURING SHOE LACES

[75] Inventor: Richard Kimbrough, New York, N.Y.

[73] Assignee: Brookside Products Limited, Hong Kong, Hong Kong

[21] Appl. No.: 114,913

[22] Filed: Oct. 30, 1987

[51] Int. Cl.[4] ..... F16G 11/00

[52] U.S. Cl. ..... 24/117; 24/120

[58] Field of Search ..... 24/117, 118, 119, 120, 24/134 KB, 134 L; 36/50

[56] References Cited

U.S. PATENT DOCUMENTS

| | | | |
|---|---|---|---|
| 575,412 | 1/1897 | Bloom | 24/120 |
| 670,561 | 3/1901 | Hoegemann . | |
| 674,824 | 4/1900 | Girtanner . | |
| 819,884 | 5/1906 | Higgins | 24/120 |
| 881,041 | 3/1908 | Almstead | 24/134 KB |
| 1,305,884 | 6/1919 | Chromy . | |
| 2,200,895 | 5/1940 | Rio . | |
| 3,066,370 | 12/1962 | Epstein | 24/117 |
| 3,114,950 | 12/1963 | Sellman . | |
| 3,176,362 | 4/1965 | Tames . | |
| 3,225,402 | 12/1965 | Altman et al. | 24/120 |
| 3,290,745 | 12/1966 | Maxwell et al. | 24/120 |
| 3,418,733 | 12/1968 | Tyrrell, Sr. et al. | 24/117 |
| 3,473,198 | 10/1969 | Meier . | |
| 4,465,011 | 8/1984 | Merry | 24/134 L |
| 4,553,293 | 11/1985 | Blum . | |
| 4,715,094 | 12/1987 | Herdman | 24/117 |

FOREIGN PATENT DOCUMENTS

| | | | |
|---|---|---|---|
| 194277 | 1/1908 | Fed. Rep. of Germany . | |
| 16527 | of 1904 | United Kingdom | 24/120 |
| 135431 | 11/1919 | United Kingdom | 24/120 |

*Primary Examiner*—Victor N. Sakran

*Attorney, Agent, or Firm*—Blum Kaplan

[57] ABSTRACT

An apparatus for securing a shoe lace during intermediate stages of shoe lace tying as well as after tying is provided. First and second jaw members define a jaw opening and are adapted for mounting on a shoe with the jaw opening facing away from the shoe. At least one of the jaw members is displaceable away from the jaw opening and is biased closed. A portion of the periphery of at least one of the jaw members adjacent the jaw opening is inclined toward the jaw opening to define a camming surface for guiding the shoe lace to the jaw opening and for permitting the force of the shoe lace being pulled to displace the movable jaw member against the biasing force so that the shoe lace can enter and be retained in the apparatus. The jaw members can include a cavity to receive a knot and teeth at the periphery of the jaw opening for retaining the lace. The movable jaw member is mounted by an over center hinge permitting selective opening of the apparatus to release a knot.

51 Claims, 3 Drawing Sheets

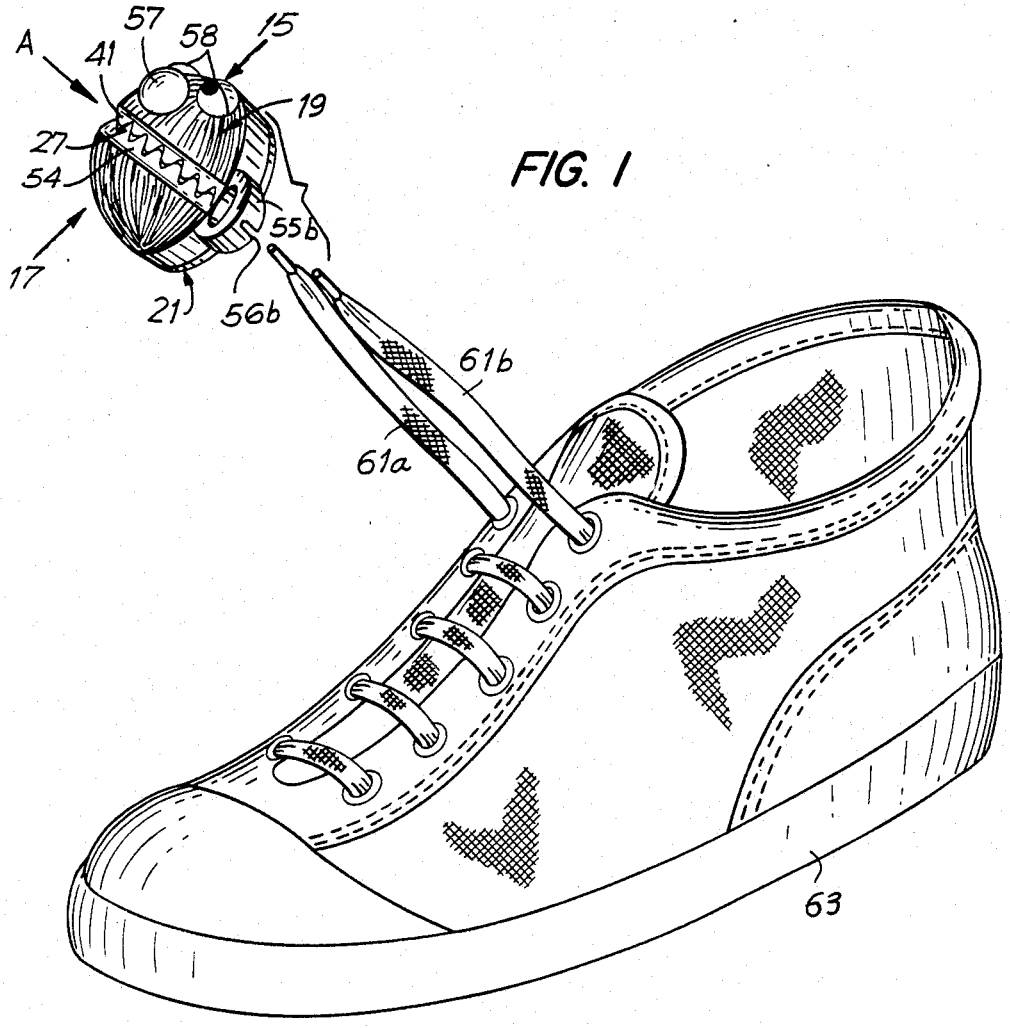
FIG. 1
FIG. 2
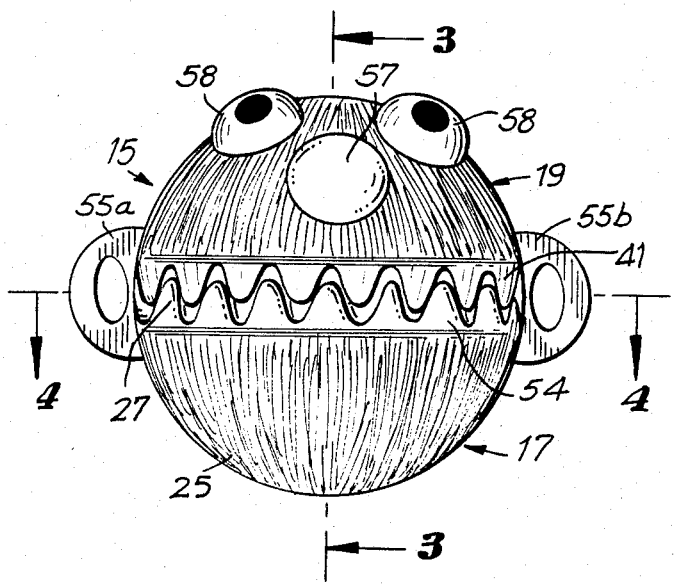
FIG. 3
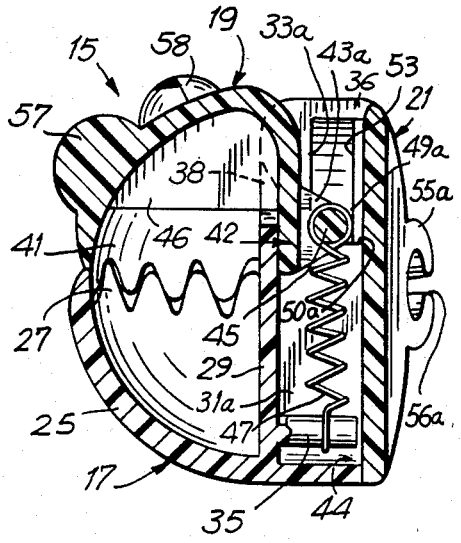

APPARATUS FOR SECURING SHOE LACES

BACKGROUND OF THE INVENTION

This invention relates to an apparatus for securing shoe laces in general, and in particular, to an apparatus for securing shoe laces which allow securing of a tied shoe lace during intermediate stages in the production of a bow, and is at the same time aesthetically pleasing.

Shoe lace clasps for securing a tied shoe lace are known in the art and fall into several separate categories of construction. The first category, includes a biased clip and is exemplified in U.S. Pat. No. 3,114,950. This prior art clasp is made of two opposed jaw members each having an outwardly extending flange at one end. A pivot shaft is inserted at the base of the flanges between the flanges and the jaws, and a spring is provided about the shaft to bias the jaws closed. After the knot is tied this clip is placed over the bow so that the jaws engage the strings extending from the knot to keep the knot tight. A second category of shoe lace clasp, exemplified in U.S. Pat. No. 670,561, consists of a hinged clasp having teeth in at least one section of the clasp. The clasp is manually folded upon itself so that the ends of the laces are secured between two parts of the hinged clasp, thereby eliminating the need for a knot.

A third category of shoe lace clasps, exemplified by U.S. Pat. Nos. 647,824, 3,176,362, 3,474,198 and 4,553,293, are retained in the laces or shoe and releasably engage the knot or the laces on either side of the knot to maintain the knot tight. These clasps are manually opened and closed. A forth category of shoe lace clasps, exemplified by U.S. Pat. No. 2,200,895, consists of a stationary jaw defining a socket mounted on the shoe and a movable wedge shaped jaw biased by a spring toward the stationary jaw but movable relative thereto. The ends of shoe laces extend between the stationary and moving jaws and are retained thereby, without the need for a knot.

Shoe lace clasps employing ornamental character figures are also known in the art as exemplified by U.S. Pat. Nos. 3,473,198 and 670,561.

These prior art shoe lace clasps have not been satisfactory. The biased and hinged shoe lace clasps suffer from the disadvantage of being limited to use only in connection with a shoe lace that has been previously tied or are intended for use without a knot. Especially for use by children, it is desired to provide a shoe lace clasp which will automatically retain the knot at all stages of construction so as to aid in knot tying and permit lace retention at varying ages and levels of manual dexterity and knot tying skills. Further, especially of use of children, it is desired to provide a shoe lace clasp with play value and character association in order to encourage the user thereof. Accordingly, it is desireable to provide an apparatus for securing shoe laces which overcomes the shortcomings of the prior art devices described above.

SUMMARY OF THE INVENTION

Generally speaking, in accordance with the invention, a shoe lace securing device adapted to secure the shoe lace at intermediate stages of knot tying, as well as to encourage the use thereof through play value and aesthetic value is provided. The device has first and second jaw members adapted for mounting on a shoe with the jaw opening facing away from the shoe. At least one jaw member is displaceable away from the other jaw member at the jaw opening and spring means is provided to bias the jaw opening closed. At least a portion of the outer surface of at least one of the jaw members is inclined toward the jaw opening to define a camming surface for guiding the laces to the jaw opening and to permit the laces, as they are pulled by the user, to displace the at least one jaw member to permit the laces at various stages of knot preparation to enter and be captured by the jaws. At least one of the jaw members is provided with projection toward the other for engaging and retaining the laces. The projections are preferably in the form of interlocking teeth along the periphery of the jaw members at the jaw opening. The first and second jaw members are joined at an over center hinge coupling so that the second jaw member may be movably displaced to and held at a jaw open position to permit opening of the knot. Openings may be provided in one of the jaw members or a base member supporting same through which the laces can initially extend to position the device.

The entire device may be formed in the shape of a character. On such an embodiment, the jaws of the device correspond to the mouth of the character. Ears having openings therethrough receive the shoe laces, thereby anchoring the device to the shoe during tying. A projection on the second jaw member defines a nose and a knot for manual manipulation thereof.

Accordingly, it is an object of this invention to provide an improved apparatus for securing shoe laces.

Another object of the this invention is to provide an apparatus for securing shoe laces which allows for the securing of the shoe lace during intermediate steps of tying.

A further object of this invention is to provide a shoe clasp which is aesthetically pleasing.

Yet another object of this invention is to provide a shoe lace clasp which encourages the user to tie their shoes through play value.

Still other objects and advantages of the invention will in part be obvious and will in part be apparent from the specification and drawings.

The invention accordingly comprises features of construction, combinations of elements and arrangements of parts which will be exemplified in the construction hereinafter set forth and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 1 is a perspective view of an apparatus for securing shoe laces in accordance with the invention operatively positioned for mounting on a shoe;

FIG. 2 front elevational view of the apparatus for securing shoe laces in accordance with the invention;

FIG. 3 is a sectional view taken along line 3—3 of FIG. 2;

DETAILED DESCRIPTION OF THE PREFERRED EMBODIMENT

Figure 4:
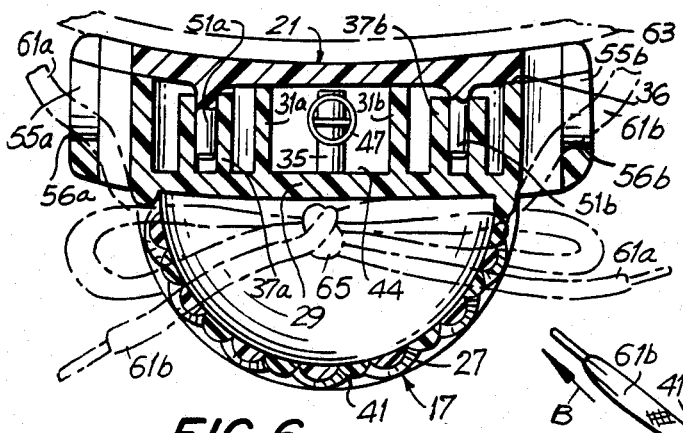
FIG. 4 a sectional view taken along line 4—4 of FIG. 2 showing the position of a tied shoe lace in phantom.

Reference is made to FIGS. 1–4, 9 and 10, wherein an apparatus for securing shoe laces, generally indicated as 15, in accordance with the invention, is depicted. The apparatus includes a first jaw member 17, a second jaw member 19 and a curved base member 21. First jaw member 17 is mounted on base member 21, while second jaw member 19 is mounted on first jaw member 17 by an over center hinge arrangement more particularly described below.

First jaw member 17 is formed with an essentially circular base portion 23 and an essentially half-hemispherical hollow jaw portion 25 extending upwardly for essentially one half of the periphery of base portion 23. Teeth 27 project from the perimeter of jaw portion 25 toward second jaw member 19.

Figure 6:
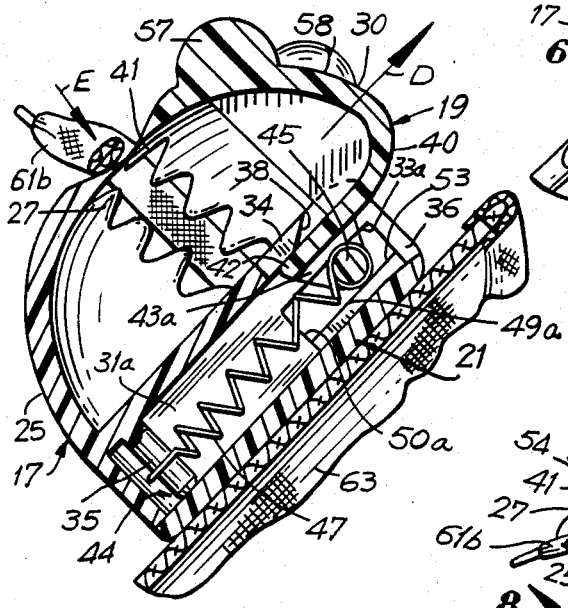
FIG. 6 is a sectional view taken along line 6—6 of FIG. 5.
Figure 8:
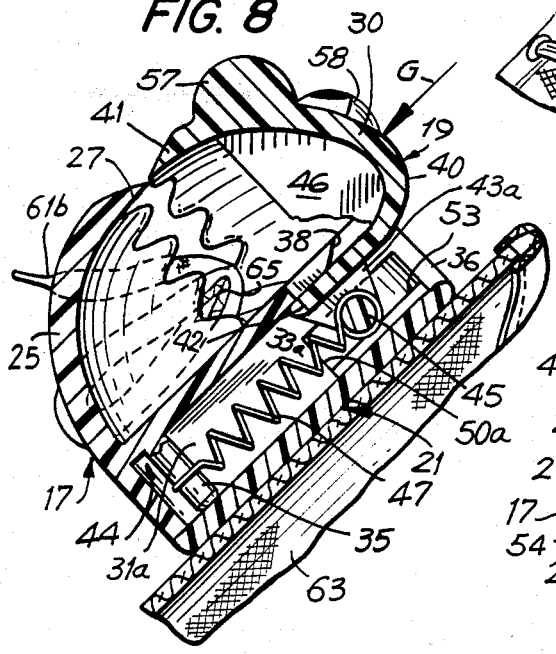
FIG. 8 is a sectional view taken along line 8—8 of FIG. 7.
Figure 10:
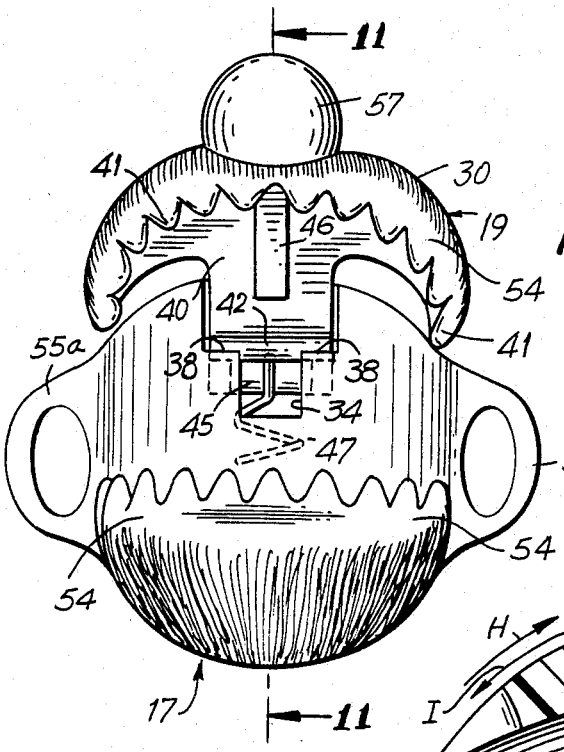
FIG. 10 is a front elevational view of the apparatus for securing shoe the open position.

Base portion 23 is formed with a transverse wall 29 and an annular rim 36 projecting downwardly from the periphery thereof. A pair of parallel ribs 31*a*, 31*b* extend along wall 29, bridging rim 36. Ribs 31*a*, 31*b* define a channel 44 therebetween and are formed with notches 33*a*, 33*b* respectively. A pin 35 extends from wall 29 between ribs 31*a*, 31*b*, at one end of channel 44. An annular projection 37*a* extends from wall 29 between rib 31*a* and rim 36. Similarly, an annular projection 37*b* extends from wall 29 and is disposed between rib 31*b* and rim 36. The height of rim 36 varies to conform with the curvature of base member 21. Ribs 31*a*, 31*b*, pin 35 and annular projections 37*a*, 37*b* do not extend beyond outer rim 36. Base portion 23 is formed with a notch 32 in wall 29 and rim 36 extending between ribs 31*a*, 31*b* to the periphery of base portion 23 (FIGS. 6, 8 and 10). Notch 32 communicates with a narrower inner notch 34 extending towards jaw portion 25 intermediate ribs 31*a*, 31*b*. The base 38 of notch 32 on either side of the entrance to inner notch 34 is beveled in the direction of base member 21 and pin 35 to define a camming surface as more particularly described below.

Second jaw member 19 is formed with an essentially half-hemispherical hollow jaw portion 30 and hinge support portion including a curved downwardly projecting portion 40 in the central region of the lower periphery of jaw portion 30 dimensioned to fit in notch 32 and extending from downwardly projecting portion 40 in a direction away from the periphery of jaw portion 30 so as to be essentially parallel to transverse wall 29 when the jaw members are closed (FIG. 3). A reinforcing rib 46 bridges a portion of jaw portion 30, projecting portion 40 and tongue 42 and is dimensioned to be received in inner notch 34. Second jaw member 19 is also provided with a row of teeth 41 which project from the perimeter of jaw portion 30 toward first jaw member 17.

Teeth 27 and 41 are formed with front surfaces which are inclined toward the periphery and interior of jaw members 17 and 19 to define camming surfaces for the purpose of guiding the laces as more particularly described below. The inclined camming surfaces can start inwardly of the teeth (a lip region) if desired. Teeth 27 and 41 are respectively staggered so as to interlock. The side surfaces of the respective teeth are inclined from the narrow ends thereof to likewise provide camming surfaces for guiding the laces. While the front and side surfaces of teeth 27 and 41 are shown as being nearly conical in shape, this is by way of example and not by way of limitation. Other tooth shapes can be used. If teeth are not provided, the outer surface adjacent the facing periphery of one or both jaw members can be inclined toward the interior and periphery of the jaw members to define said camming surfaces. The camming surfaces on the front or outer surface of teeth or outer periphery of a jaw member can be provided only at a portion of the periphery sufficient to permit pressure on the laces to cause the opening of the jaw members by the displacement of the laces along the camming surface. If no teeth are provided, suitable projections or a notch in the periphery of one of the jaw members close to base member 21 for capturing the laces may be provided.

A pair of spaced supports 43*a*, 43*b* extend from the underside of tongue 42 of second jaw member 19. A pin 45 is supported by supports 43a, 43*b* and extends therebetween and on either side of the pair of supports. Supports 43*a*, 43*b* are dimensioned to pass between ribs 31*a*, 31*b* in channel 44 and to cooperate therewith to provide lateral stability for second jaw member 19 when mounted on first jaw member 19. Second jaw member 19 is mounted on first jaw member 17 so that the ends of pin 45 are positioned within notches 33*a*, 33*b*. A spring 47 is anchored at one end to pin 35 and at its other end to the central region of pin 45. Spring 47 applies a bias force to bring second jaw member 19 in contact with first jaw member 17 so that teeth 27 mesh with teeth 41. Pin 45 travels along a portion of grooves 33*a*, 33*b* allowing upper jaw 19 to separate from lower jaw 17 when a force is applied.

Figure 9:
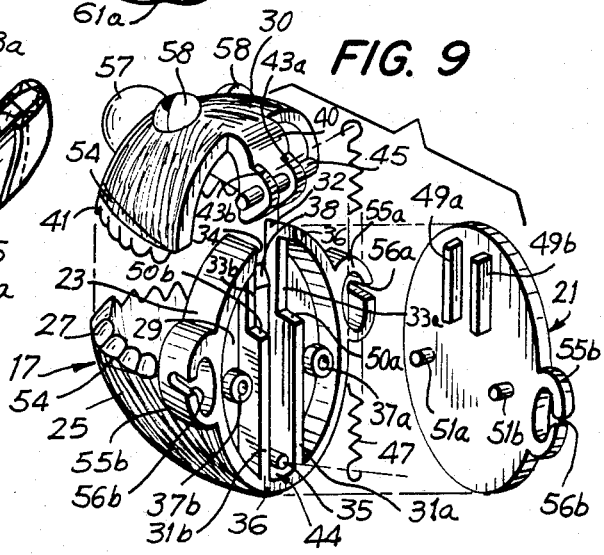
FIG. 9 an exploded view of the apparatus for securing shoe laces.

As more particularly shown in FIGS. 3, 9 and 10, base member 21 is formed with a pair of ribs 49*a*, 49*b* projecting upwardly therefrom. Ribs 49*a*, 49*b* are in registration with and are received by notches 33*a*, 33*b* in ribs 31*a*, 31*b* respectively. Ribs 49*a*, 49*b* do not extend completely into notches 33*a*, 33*b* thereby leaving a channel 53 formed between the outer edge of each rib 49*a*, 49*b* and the respective base of the corresponding notch 33*a*, 33*b*. in ribs 31*a*, 31*b* Each channel 53 is dimensioned to receive, with clearance, one end of pin 45 and is defined at an inner end by the respective side wall 50*a*, 50*b* of notches 33*a*, 33*b*, and at an outer end by rim 36. This allows for the movement of pin 45 in channels 53 along base plate 21. This construction allows displacement of second jaw portion 19 only in the direction of Arrow D (FIGS. 5 and 6) during knot tying. The length of channels 53 permits the displacement of pin 45 in the direction along base portion 21 a distance sufficient to permit pivoting of second jaw member 19 about pin 45 when opened as more particularly described below. Base member 21 is also formed with posts 51*a*, 51*b* which project upwardly in registration with the holes in annular projections 37*a* and 37*b*. Posts 51*a*, 51*b* are received in said holes to secure back member 21 to first jaw member 17. Base member 21 is mounted upon first jaw member 17 in a flush manner, in engagement with rims 36 and 40. A ring 55*a*, 55*b* having respective grooves 56*a*, 56*b* therein is formed on each side of base member 21.

Lips may be formed on second upper jaw member 19 and first jaw member 17 adjacent to teeth 41 and teeth 27 respectively. This is to give the appearance of a mouth with teeth where teeth 41 mesh with teeth 27. To further give shoe lace clasp 15 an overall appearance of a character, a nose 57 extends from the center of upper jaw 19 between a pair of eyes 58 projecting from said second jaw member. Rings 55*a*, 55*b* are positioned relative to nose 57 and eyes 58 to give the appearance of ears. This results in giving shoe lace clasp 15 an overall appearance of a character in which functional parts of the character face are used to aid in securing the shoe lace. A humanoid character is used by way of example only and any animal or fictitious character having a mouth may also be substituted. Nose 57 and eyes 58 may be painted or drawn directly onto the surface of upper jaw portion.

Figure 5:
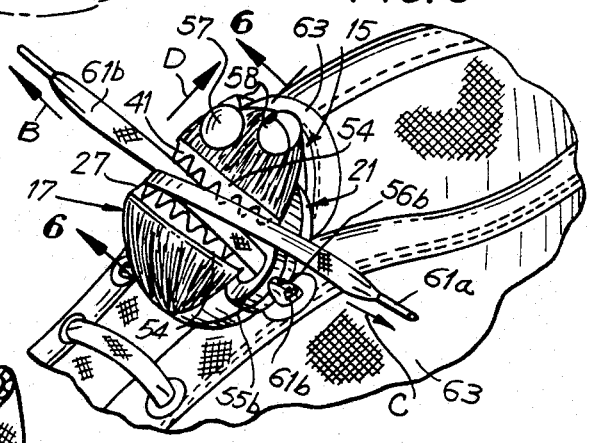
FIG. 5 is a perspective view of the apparatus for securing shoe laces in accordance with the invention mounted on a shoe with the laces in an intermediate step of knot tying.

Reference is now made to FIGS. 1 and 3–11 wherein the operation of the device for securing shoe laces in accordance with the invention is described. Ends 61*a*, 61*b* of a shoe lace secured to a shoe 63 are passed through rings 55*a*, 55*b* respectively. Clasp 15 is slid down shoe lace ends 61*a*, 61*b* in the direction of arrow A until base portion 21 contacts shoe 63. Since base portion 21 is curved, clasp 15 rests flush upon shoe 63. As the shoe user grips the shoe laces during tying, laces 61*a*, 61*b* are pulled through grooves 56*a*, 56*b* of rings 55*a*, 55*b* so as to grasp the shoe lace and anchor clasp 15 to shoe 63 during tying. Shoe lace ends 61*a*, 61*b* are then crossed across the mouth formed by teeth 41 and teeth 27 and one end is passed under the other in the first step in forming a knot. The ends are pulled apart in the directions of arrows B and C, to accomplish the first stage of shoe tying. (FIGS. 5 and 6 ). As discussed above, teeth 27, 41 are angled in the direction of shoe 63 the perspective periphery and interior of jaw members 17, 19 to define camming surfaces. This causes shoe lace ends 61*a*, 61*b* to slide along teeth 41, 27 towards the inside of clasp 15, causing the displacement of second jaw member 19 in the direction of arrow D (FIGS. 5 and 6) to permit the engaged portions of lace ends 61*a*, 61*b* defining the first stage of a knot, to travel in the direction of arrow E. The force of the shoe lace ends being pulled in the direction of arrows B and C causes second jaw member 19 to overcome the forces of spring 47, allowing the opening of the jaws. When the lace ends and first stage of the knot are stopped by engagement with the interior of clasp 15, the first stage of the knot is captured and held in position inside the clasp, even if the next step of the knot tying is not performed.

Figure 7:
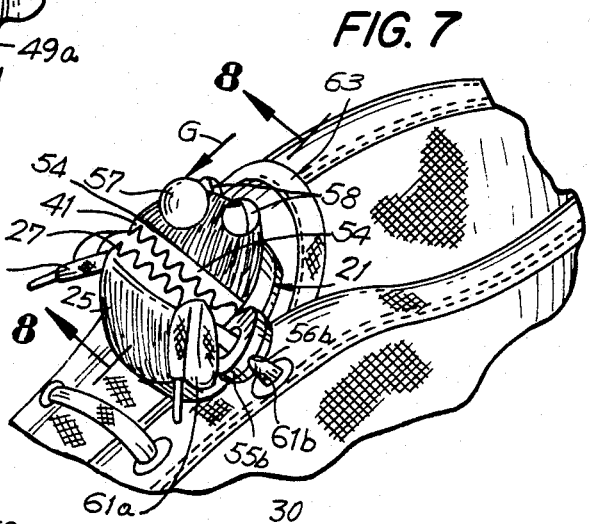
FIG. 7 perspective view of the apparatus for securing shoe laces in accordance with the invention mounted on a shoe with the laces tied in a bow knot.

Roughly the same procedure is conducted for completing the bow tying portion of tying a shoe lace. Each lace end 61*a*, 61*b* is folded and then wrapped around the other to form a loose bow knot 65. Each folded end is then pulled apart from each other causing knot 65 to move in the direction of arrow C towards the interior of clasp 15 to the first stage of the knot, which is held tight by the biased jaws. Again, due to the inclined teeth 41, 27, second jaw member 19 separates from first jaw member 17 in the direction of arrow D to accommodate knot 65. Furthermore, once the motion of knot 65 has been completed spring 47 provides a force in the direction of arrow G to clamp teeth 27 and teeth 41 against the lace on either side of knot 65, thereby securing the knot in place. (FIGS. 7 and 8). Accordingly, a clasp which may be used during tying as well as after tying is provided.

Figure 11:
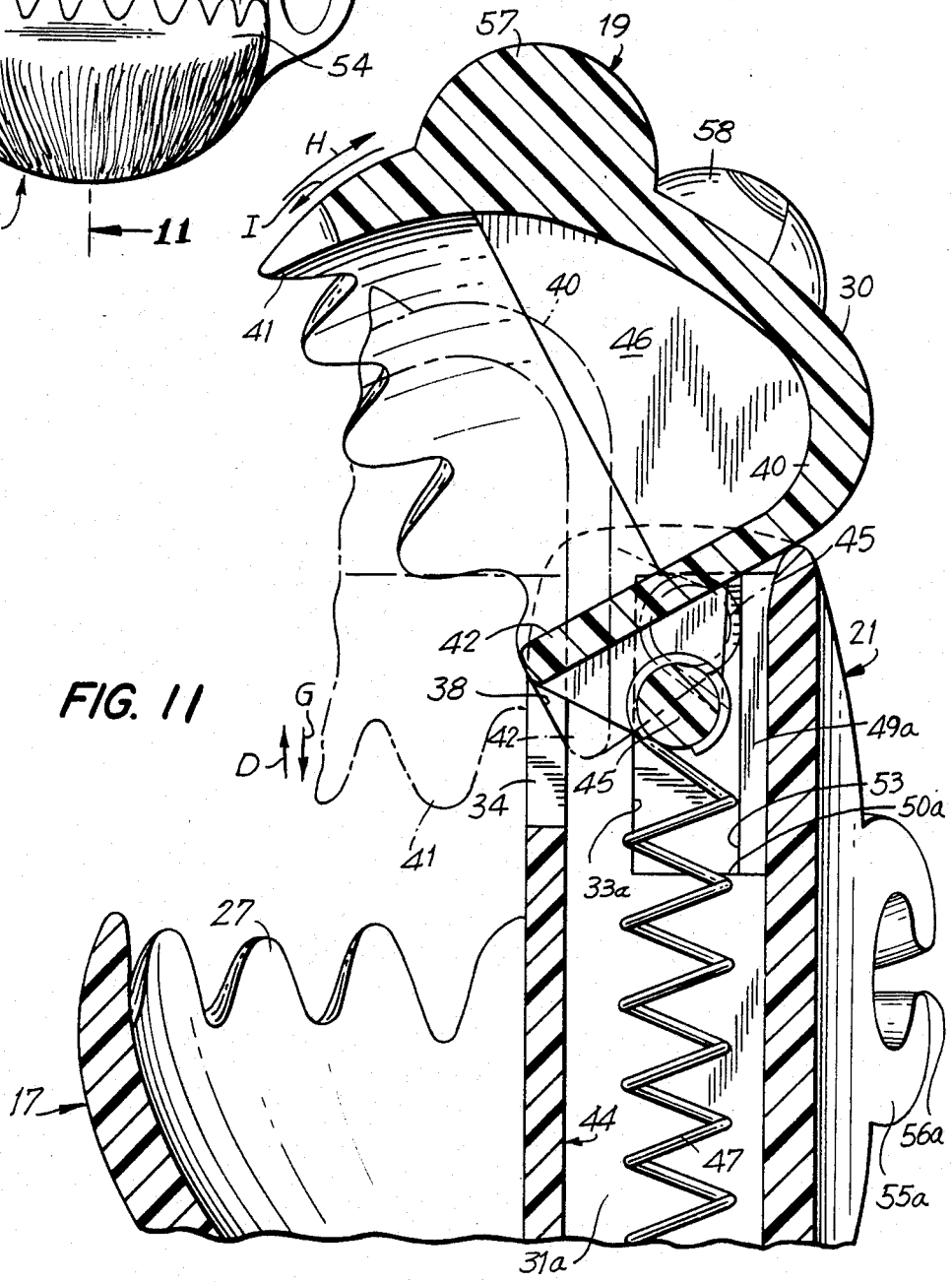
FIG. 11 is an enlarged fragmentary sectional view taken along line 11—11 of FIG. 10.

When it is desired to untie the shoe lace, clasp 15 is opened by manually displacing second jaw member 19 to the position shown in FIGS. 10 and 11 by displacing jaw member 19 in the direction of arrow D until the end of tongue 42 clears notch 34. The knob defined by nose 57 provides a convenient lever for this manipulation. If desired, a handle member could be provided coupled to second jaw member 19 to provide a larger means for grasping by the user to pull second jaw member 19 in the direction of arrow D to open clasp 15. As tongue 42 clears inner notch 34, the end of tongue 42 engages the beveled base 38 of notch 32 and is cammed therealong as second jaw member 19 is pivoted in the direction of arrow H (FIG. 11) to the open position. During this maneuver second jaw member 19 moves in the direction of arrow D to an over center position shown in phantom lines in FIG. 11 to permit the pivoting and then returns in the direction of arrow G to an open position. The mounting of second jaw member 19, namely the interlocking of tongue 42 and base 38 except at an extreme position of the pin 45 in channel 53, provides an over center arrangement which prevents inadvertent opening and closing thereof.

In the open position, as seen in solid lines in FIGS. 10 and 11, projecting portion 40 rests on the periphery of base member 21 and tongue 42 rests on the base 38 of notch 32. The second jaw member 19 is hold in this position by spring 47. To close the second jaw member, the jaw member is pivoted in the direction of arrow I (FIG. 11), causing pin 45 to move in the direction of arrow D to permit pivoting. Once over center, the force of spring 47 causes the completion of the pivoting by the engagement of the end of tongue 42 on base 38, and the displacement of second jaw member 19 in the direction of arrow G to the closed position. Accordingly, the action of spring 47 tends to hold second jaw member 19 at either the open or closed position.

It should be noted that although rings 55*a*, 55*b* provide an anchor during tying they are not necessary for the functioning of the clasp. Because of the force of spring 47, once the first portion of lace ends 61*a* or 61*b* are secured within teeth 21, 47, clasp 15 will act to anchor itself when it grips the shoe lace.

The shoe lace clasp in accordance with the invention is easy to use by small children and permits retention of each step in the tying for a knot. Because the jaws are formed into a mouth, giving the appearance of the clasp eating the shoe lace, the play value of the shoe lace clasp is enhanced which in turn encourages young users to tie their shoes. The configuration also permits the use of a wide range of character and animal faces, further enhancing the play value and aesthetic appeal. Spring 47 can be a rubber band. The coupling between the jaw members can be a living hinge having a snap spring providing the over center feature.

It will thus be seen that the objects set forth above, among those made apparent from the preceeding description, are efficiently attained and, since certain changes may be made in the above construction without departing from the spirit and scope of the invention, it is intended that all matters contained in the above description and shown in the accompanying drawing shall be interpreted as illustrative and not in a limiting sense.

It is also to be understood that the following claims are intended to cover all the generic and specific features of the invention herein described and all statements of the scope of the invention in which, as a matter of language, might be said to fall therebetween.

What is claimed is:

1. An apparatus for securing a shoe lace having an intermediate portion and end portion on either side thereof, comprising:

first and second jaw members defining a jaw opening therebetween and adapted for mounting on a shoe with the jaw opening facing away from the shoe, means permitting the manual displacement of at least one of the jaw members away from the other at the jaw opening;

biasing means for biasing the first and second member toward each other to close the jaw opening, at least a portion of the outer surface adjacent the jaw opening of at least one of the jaw members being inclined toward the jaw opening to define an entrance to the jaw opening and a camming surface for guiding the intermediate portion of the shoe lace laterally into the jaw opening and for permitting the force of the shoe lace ends being pulled by the user away from the apparatus to displace the at least one displaceable jaw member against the force of the biasing means and, retaining means within the jaw opening for retaining the intermediate portion of the shoe lace therein while permitting release of the intermediate portion of the shoe lace when the at least one jaw is manually displaced to open the jaw opening, the retaining means including the biasing means whereby the shoe lace intermediate portion enters the apparatus and is releasably retained in the apparatus.

2. The apparatus of claim 1, wherein said retaining means includes projections formed in at least one of said jaw members extending toward the other jaw member for engaging and retaining the intermediate portion of the shoe lace.

3. The apparatus of claim 2, wherein said projections comprise teeth disposed along at least a portion of the periphery adjacent the jaw opening of one of said jaw members.

4. The apparatus of claim 2, wherein at least the outer surfaces of said teeth are inclined to define said camming surfaces.

5. The apparatus of claim 4, wherein said teeth are on the facing peripheries of both of said end members and arranged in staggered interlocking relationship.

6. The apparatus of claim 5, wherein at least a portion said teeth are formed with the side thereof facing the entrance to the jaw opening inclined away from the entrance to the jaw opening to define camming surfaces for facilitating the entry of the shoe lace into the region between the jaw members.

7. The apparatus of claim 5, wherein said retaining means further includes a cavity formed in at least one of the jaw members inward of the periphery adjacent the jaw opening for receiving and retaining a knot or knot portion formed from said shoe lace.

8. The apparatus of claim 7, wherein said means permitting the manual displacement of at least one of the jaw members includes over center hinge means supporting said second jaw member relative to said first jaw member and permitting displacement of said second jaw member between a first position at which it is displaceable by a shoe lace applied at the entrance opening for receiving and retaining said shoe lace and a second open position at which said second jaw member is pivoted so that a knotted shoe lace is released and can be opened and the apparatus removed.

9. The apparatus of claim 8, wherein the bias means engages the over center hinge means for biasing said second jaw member against said first jaw member, for providing resistance to the displacement of said second jaw member from said first position to said second position and for retaining said second jaw member at said second position when placed therein.

10. The apparatus of claim 8, wherein the over center hinge means includes channel means for permitting longitudinal displacement of said second jaw member relative to said first jaw member to open the jaw opening, and interlocking means adapted to permit pivoting of the second jaw member only after a predetermined longitudinal displacement.

11. The apparatus of claim 9, wherein at least one of said jaw members is formed to define, together with the teeth, the appearance of the face or head of a character, humanoid or animal.

12. The apparatus of claim 11, wherein the second jaw member is formed with a projection defining a feature of said face or head and also usable for engagement for manual manipulation of said second jaw member from its first to its second position.

13. The apparatus of claim 11, and including means for anchoring the apparatus to a shoe.

14. The apparatus of claim 13, wherein said anchoring means comprises a pair of rings on opposed sides of the jaw opening for receipt of the ends of said shoe lace, said rings being secured to at least one of said jaw members.

15. The apparatus of claim 14, wherein said rings have the appearance of ears of the head or face.

16. The apparatus of claim 14, wherein each of said rings is formed with a notch on the side thereof facing the shoe for engagement with the shoe lace.

17. The apparatus of claim 1, wherein said retaining means includes a cavity formed in at last one of the jaw members inward of the periphery adjacent the jaw opening for receiving and retaining a knot or knot portion formed from said shoe lace.

18. The apparatus of claim 17, and including means for anchoring the apparatus to a shoe.

19. The apparatus of claim 17, wherein at least one of said jaw members is arranged to define all or a part of a head or face of a character, humanoid or animal.

20. The apparatus of claim 19, wherein said head or face is defined by at least said one jaw member and said jaw opening defines the mouth thereof.

21. The apparatus of claim 17, wherein said means permitting the manual displacement of at least one of the jaw members includes over center hinge means pivotably supporting said second jaw member relative to said first jaw member and permitting displacement of said second jaw member between a first position at which it is displaceable by a shoe lace applied at the entrance opening for receiving and retaining said shoe lace and a second open position at which a knotted shoe lace can be opened and the apparatus removed.

22. The apparatus of claim 21, wherein the bias means engages the over center hinge means for biasing said second jaw member against said first jaw member, for providing resistance to the displacement of said second jaw member from said first position to said second position and for retaining said second jaw member at said second position when placed therein.

23. The apparatus of claim 22, wherein the over center hinge means includes channel means for permitting longitudinal displacement of said second jaw member relative to said first jaw member to open the jaw opening, and interlocking means adapted to permit pivoting of the second jaw member only after a predetermined longitudinal displacement.

24. The apparatus of claim 21, wherein said retainer means further includes a cavity formed in at least one of the jaw members inward of the periphery adjacent the jaw opening for receiving and retaining a knot or knot portion formed from said shoe lace.

25. The apparatus of claim 1, wherein the means permitting the manual displacement of at least one of the jaw members includes over center hinge means pivotably supporting said second jaw member relative to said first jaw member and permitting displacement of said second jaw member between a first position at which it is displaceable by a shoe lace applied at the entrance opening for receiving and retaining said show lace and second open position at which a knotted shoe lace is released and can be opened and the apparatus removed.

26. The apparatus of claim 25, wherein the bias means engages the over center hinge means for biasing and said second jaw member against said first jaw member, for providing resistance to the displacement of said second jaw member from said first position to said second position and for retaining said second jaw member at said second position when placed therein.

27. The apparatus of claim 26, wherein the over center hinge means includes channel means for permitting longitudinal displacement of said second jaw member relative to said first jaw member to open the jaw opening, and interlocking means adapted to permit pivoting of the second jaw member only after a predetermined longitudinal displacement.

28. The apparatus of claim 25, wherein at least one of said jaw members is arranged to define all or a part of a head or face of a character, humanoid or animal.

29. The apparatus of claim 28, wherein said head or face is defined by at least said one jaw member and said jaw opening defines the mouth thereof.

30. The apparatus of claim 28, wherein the second jaw member is formed with a projection defining a feature of said face or head and also usable for engagement for manual manipulation of said second jaw member from its first to its second position.

31. The apparatus of claim 25, and including means for anchoring the apparatus to a shoe.

32. The apparatus of claim 1, wherein at least one of said jaw members is arranged to define all or a part of a head or face of a character, humanoid or animal.

33. The apparatus of claim 32, wherein said head or face is defined by at least said one jaw member and said jaw opening defines the mouth thereof.

34. The apparatus of claim 33, wherein the second jaw member is formed with a projection defining a feature of said face or head and also usable for engagement for manual manipulation of said second jaw member.

35. The apparatus of claim 32, wherein said retaining means further includes a cavity formed in at least one of the jaw members inward of the periphery adjacent the jaw opening for receiving and retaining a knot or knot portion formed from said shoe lace.

36. The apparatus of claim 32, wherein said means permitting the manual displacement of at least one of the jaw members includes over center hinge means pivotably supporting said second jaw member relative to said first jaw member and permitting displacement of said second jaw member between a first position at which it is displaceable by a shoe lace applied at the entrance opening for receiving and retaining said shoe lace and a second open position at which a knotted shoe lace is released and can be opened and the apparatus removed.

37. The apparatus of claim 36, wherein the bias means engages the over center hinge means for biasing said second jaw member against said first jaw member, for providing resistance to the displacement of said second jaw member from said first position to said second position and for retaining said second jaw member at said second position when placed therein.

38. The apparatus of claim 32, and including means for anchoring the apparatus to a shoe.

39. The apparatus of claim 5, wherein at least one of said jaw members is formed to define, together with the teeth, the appearance of the face or head of a character, humanoid or animal.

40. The apparatus of claim 39, wherein the means permitting the manual displacement of at least one of the jaw members includes over center hinge means pivotable supporting said second jaw member relative to said first jaw member and permitting displacement of said second jaw member between a first position at which it is displaceable by a shoe lace applied at the entrance opening for receiving and retaining said shoe lace and second open position at which a knotted shoe lace is released and can be opened and the apparatus removed.

41. The apparatus of claim 40, wherein the bias means engages the over center hinge means for biasing said second jaw member against said first jaw member, for providing resistance to the displacement of said second jaw member from said first position to said second position and for retaining said second jaw member at said second position when placed therein.

42. The apparatus of claim 41, wherein the over center hinge means includes channel means for permitting longitudinal displacement of said second jaw member relative to said first jaw member to open the jaw opening, and interlocking means adapted to permit pivoting of the second jaw member only after a predetermined longitudinal displacement.

43. The apparatus of claim 39, wherein the second jaw member is formed with a projection defining a feature of said face or head and also usable for engagement for manual manipulation of said second jaw member from its first to its second position.

44. The apparatus of claim 7, wherein at least one of said jaw members is formed to define, together with the teeth, the appearance of the face or head of a character, humanoid or animal.

45. The apparatus of claim 1, and including means for anchoring the apparatus to a shoe.

46. The apparatus of claim 45, wherein said anchoring means comprises a pair of rings on opposed sides of the jaw opening for receipt of the ends of said shoe lace, said rings being secured to at least one of said jaw members.

47. The apparatus of claim 46, wherein each of said rings is formed with a notch on the side thereof facing the shoe for engagement with the shoe lace.

48. The apparatus of claim 5, and including means for anchoring the apparatus to a shoe.

49. The apparatus of claim 7, and including means for anchoring the apparatus to a shoe.

50. The apparatus of claim 8, and including means for anchoring the apparatus to a shoe.

51. The apparatus of claim 25, and including means coupled to said second jaw member for grasping by the user for manual displacement of said second jaw member between the first and second positions.

* * * * *